US009103339B2

(12) United States Patent
Gammon

(10) Patent No.: US 9,103,339 B2
(45) Date of Patent: Aug. 11, 2015

(54) PISTON PUMP

(76) Inventor: James H. Gammon, Manasquan, NJ (US)

( * ) Notice: Subject to any disclaimer, the term of this patent is extended or adjusted under 35 U.S.C. 154(b) by 764 days.

(21) Appl. No.: 13/406,077

(22) Filed: Feb. 27, 2012

(65) Prior Publication Data

US 2012/0216671 A1 Aug. 30, 2012

Related U.S. Application Data

(60) Provisional application No. 61/447,244, filed on Feb. 28, 2011.

(51) Int. Cl.

| | |
|---|---|
| ***F04B 49/16*** | (2006.01) |
| ***F04B 49/12*** | (2006.01) |
| ***F04B 13/00*** | (2006.01) |
| ***F04B 49/24*** | (2006.01) |

(52) U.S. Cl.

CPC ..... *F04B 49/12* (2013.01); *F04B 13/00* (2013.01); *F04B 49/24* (2013.01)

(58) Field of Classification Search

CPC ..... F04B 49/12; F04B 49/16; F04B 49/24
USPC ..... 92/60.5; 417/213, 274, 275
See application file for complete search history.

(56) References Cited

U.S. PATENT DOCUMENTS

| | | | | |
|---|---|---|---|---|
| 2,981,198 | A * | 4/1961 | Nettel | 92/60.5 |
| 3,945,772 | A * | 3/1976 | Van de Moortele | 92/60.5 |
| 4,028,890 | A | 6/1977 | Habiger et al. | |
| 4,034,564 | A | 7/1977 | Johnson et al. | |
| 4,118,152 | A * | 10/1978 | Bron | 92/60.5 |
| 4,142,841 | A | 3/1979 | Claar et al. | |
| 4,149,830 | A | 4/1979 | Woodruff | |
| 4,241,753 | A | 12/1980 | Erwin et al. | |
| 4,424,005 | A * | 1/1984 | Manning | 417/53 |
| 4,801,247 | A | 1/1989 | Hashimoto et al. | |
| 4,934,253 | A | 6/1990 | Berthold et al. | |
| 5,183,393 | A | 2/1993 | Schaffner | |
| 5,486,097 | A | 1/1996 | Schaffner | |
| 7,690,899 | B2 | 4/2010 | Harada | |
| 8,015,964 | B2 * | 9/2011 | Eddy | 417/213 |

* cited by examiner

*Primary Examiner* — F. Daniel Lopez
(74) *Attorney, Agent, or Firm* — Fraser Clemens Martin & Miller LLC; James D. Miller

(57) ABSTRACT

A piston pump includes a main body having an inlet, an outlet, and a chamber fluidly connected to form at least a portion of a first fluid flow path for receiving a flow of fluid therein. The pump also includes a second fluid flow path to provide fluid communication between the chamber and a point upstream of the inlet of the main body. A piston is disposed in the chamber of the main body and reciprocatingly moves therein to cause the flow of the fluid through at least one of the first fluid flow path and the second fluid flow path. An adjustment element is disposed in the main body and configured to adjust an effective flow of the fluid through the first fluid flow path.

14 Claims, 2 Drawing Sheets

PISTON PUMP

CROSS-REFERENCE TO RELATED APPLICATIONS

This application claims the benefit of U.S. Provisional Patent Application Ser. No. 61/447,244 filed Feb. 28, 2011.

FIELD OF THE INVENTION

The present invention relates generally to a fluid pump. In particular, the invention is directed to a piston-type pump for controlling a flow of a fluid.

BACKGROUND OF THE INVENTION

Conventional piston-type pumps (i.e. piston pumps) include a piston that is caused to reciprocate in a chamber, thereby creating a displacement of a fluid in the chamber. An inlet check valve allows the fluid to enter the chamber from an inlet conduit and an outlet check valve allows the fluid to exit the chamber through an outlet conduit. Typically, a conventional piston pump displaces the same amount of the fluid with each stroke of the piston. For example, each time the piston moves to a bottom dead center in the chamber, a volume of the fluid flows into the chamber. Likewise, each time the piston moves to a top dead center in the chamber, the volume of the fluid in the chamber is expelled through the outlet check valve.

It would be desirable to develop a piston pump with an adjustable effective flow of a fluid from the pump, without altering the stroke of the piston.

SUMMARY OF THE INVENTION

In concordance and agreement with the present invention, a piston pump with an adjustable effective flow of a fluid from the pump, without altering the stroke of the piston, has surprisingly been discovered.

In one embodiment, a piston pump comprises; a main body including an inlet, an outlet, and a chamber formed therein, wherein the inlet, the outlet, and at least a portion of the chamber are fluidly connected to form at least a portion of a first fluid flow path; and a piston disposed in the chamber and configured to reciprocatingly move therein to cause a flow of a fluid through at least one of the first fluid flow path and a second fluid flow path providing fluid communication between the chamber and a point upstream of the inlet of the main body, wherein an effective flow of the fluid through the first fluid flow path is adjustable.

In another embodiment, a piston pump comprises: a main body including an inlet, a first outlet, and a chamber formed therein, wherein the inlet, the first outlet, and at least a portion of the chamber are fluidly connected to form at least a portion of a first fluid flow path for receiving a flow of fluid therein; a piston disposed in the chamber and configured to reciprocatingly move therein; an adjustment element at least partially disposed in the main body, the adjustment element configured to adjust an effective flow of the fluid through the first fluid flow path, wherein the adjustment element includes a plunger displaceable relative to the piston; and a second fluid flow path providing fluid communication between the chamber and a point upstream of the inlet of the main body, wherein the piston selectively abuts an end of the plunger to militate against a flow of fluid through the second fluid flow path.

In yet another embodiment, a piston pump comprises: a main body including an inlet, a first outlet, and a chamber formed therein, wherein the inlet, the first outlet, and at least a portion of the chamber are fluidly connected to form at least a portion of a first fluid flow path for receiving a flow of fluid therein; a piston disposed in the chamber and configured to reciprocatingly move therein; an adjustment element at least partially disposed in the main body, the adjustment element configured to adjust an effective flow of the fluid through the first fluid flow path, wherein the adjustment element includes a hollow body portion, a plunger having a passage formed therein and at least partially disposed in the hollow body portion, and a displacement adjuster coupled to the hollow body portion for controlling a displacement of the plunger; and a second fluid flow path at least partially formed by the passage of the plunger, an interior of the hollow body portion, and a second outlet formed in the main body, wherein the second fluid flow path provides fluid communication between the chamber and a point upstream of the inlet of the main body, wherein the piston selectively abuts an end of the plunger to militate against a flow of fluid through the second fluid flow path.

BRIEF DESCRIPTION OF THE DRAWINGS

The above, as well as other advantages of the present invention, will become readily apparent to those skilled in the art from the following detailed description of the preferred embodiment when considered in the light of the accompanying drawings in which.

DETAILED DESCRIPTION OF EXEMPLARY EMBODIMENTS OF THE INVENTION

Figure 1:
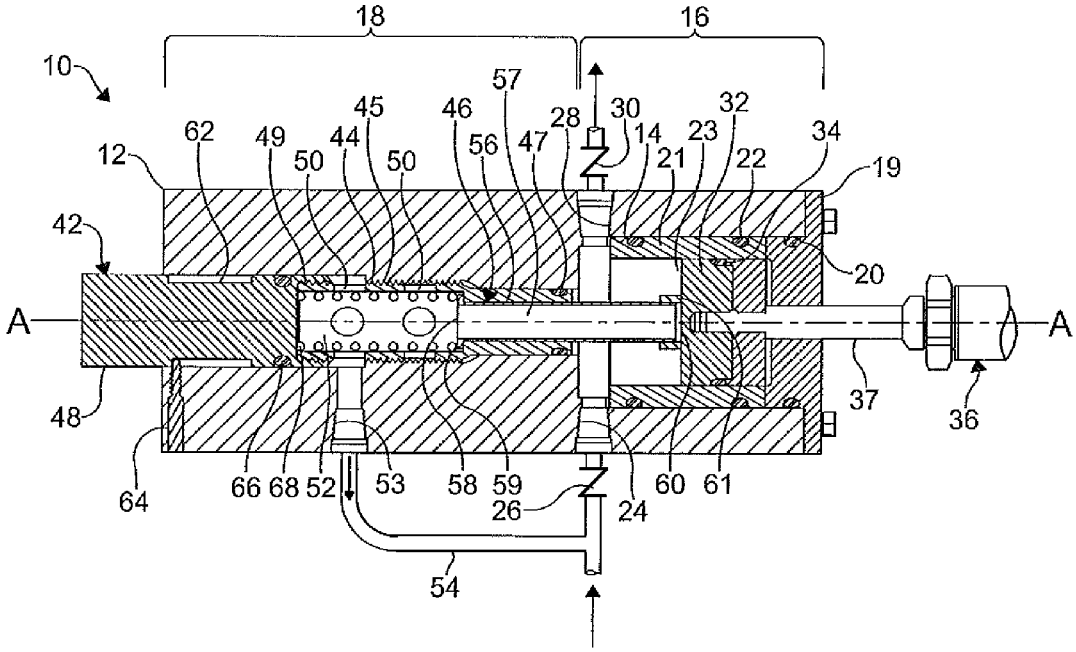
FIG. 1 is a cross-sectional side elevational view of a pump including a piston and an adjustment element according to an embodiment of the present invention showing the piston in a first position and the adjustment element in a maximum flow position.

The following detailed description and appended drawings describe and illustrate various embodiments of the invention. The description and drawings serve to enable one skilled in the art to make and use the invention, and are not intended to limit the scope of the invention in any manner. In respect of the methods disclosed, the steps presented are exemplary in nature, and thus, the order of the steps is not necessary or critical.

FIGS. 1-4 illustrate a pump 10 according to an embodiment of the present invention. The pump 10 is used for a volume-controlled feed of a fluid (e.g. liquid, foam, gas, and the like). The pump 10 includes a main body 12 having a generally cylindrical passage 14 formed therein. In the embodiment shown, the passage 14 includes a piston section 16 and a control section 18, each having a different cross-sectional area. It is understood that the passage 14 can have any size and shape. It is further understood that the piston section 16 and the control section 18 can have the same or different cross-sectional areas as desired.

In certain embodiments, a guide sleeve 21 is sealingly disposed in the piston section 16 of the passage 14, as appreciated by one skilled in the art. It is understood that the guide sleeve 21 may be replaceable if desired. In a non-limiting example, sealing members 22 (e.g. O-rings, piston rings, and the like) are disposed in respective grooves formed in an outer surface of the guide sleeve 21 to abut an inner surface of the main body 12, forming a substantially fluid-tight seal therebetween. In the illustrated embodiment, an inner surface of the guide sleeve 21 and an end cap 19 define a chamber 23 within the piston section 16 of the main body 12.

The chamber 23 is in fluid communication with an inlet 24 formed in a wall of the main body 12. An inlet valve 26 (e.g. one-way check valve) is disposed adjacent the inlet 24 to selectively control a flow of fluid (not shown) through the inlet 24 and into the chamber 23 from a source of fluid (not shown) upstream of the inlet valve 26. The chamber 23 is also in fluid communication with an outlet 28 formed in the wall of the main body 12. An outlet valve 30 (e.g. one-way check valve) is disposed adjacent the outlet 28 to selectively control a flow of the fluid out from the chamber 23 and through the outlet 28. As a non-limiting example, the outlet 28 is formed diametrically opposite the inlet 24 in the wall of the main body 12. The inlet 24, the outlet 28, and at least a portion of the chamber 23 are fluidly connected to form a first fluid flow path through the pump 10. However, any configuration of inlets, outlets, and the chamber 23 can be fluidly connected to form the fluid path through the pump 10 as desired.

A piston 32 is disposed in the chamber 23 and supported therein by the guide sleeve 21. The piston 32 shown has a substantially circular cross-sectional shape, although the piston 32 can have any cross-sectional shape as desired. As a non-limiting example, the piston 32 includes a sealing member 34 (e.g. O-ring, piston ring, and the like) disposed thereon to sealingly abut the inner surface of the guide sleeve 21. It is understood that the piston 32 can include a channel or notched portion to receive and secure the sealing member 34 therein. A drive means 36 is operatively coupled to the piston 32. The drive means 36 causes axially reciprocating movement in respect of a central axis A of the pump 10 between a first position, shown in FIG. 1, and a second position, shown in FIG. 2. As a non-limiting example, the drive means 36 is a drive shaft 37 supported in a displaceable manner in the end cap 19 which is operatively coupled to and reciprocatingly driven by a motor (not shown). Other drive means 36 can be employed to cause the axially reciprocating movement of the piston 32 as desired.

The end cap 19 is coupled to the main body 12 adjacent the piston section 16 to provide a closure to a first end of the passage 14. In a non-limiting example, a sealing member 20 (e.g. O-rings, piston rings, and the like) is disposed in a groove formed in an outer surface of the end cap 19 to abut the inner surface of the main body 12, causing the end cap 19, and thereby, the drive shaft 37 to be located in a desired position (e.g. a center position substantially parallel to the central axis A of the pump 10). It is understood that the end cap 19 can be coupled to the main body 12 by any means as desired such as by fasteners, welds, adhesive, and the like, for example.

An adjustment element 42 is at least partially disposed in the control section 18 of the passage 14. The adjustment element 42 includes a hollow body portion 44, a plunger 46, and a displacement adjuster 48 for controlling a displacement of the plunger 46.

The hollow body portion 44 of the adjustment element 42 is coupled to the inner surface of the main body 12 defining the control section 18 of the passage 14. As a non-limiting example, the hollow body portion 44 is coupled to the main body 12 by a threaded connection 45 permitting an engagement with the main body 12 and a positioning of the adjustment element 42 in a variety of configurations relative to the piston 32. As another non-limiting example, a sealing member 47 (e.g. O-rings, piston rings, and the like) is disposed in a groove formed in an outer surface of the hollow body portion 44 to abut an inner surface of the main body 12, forming a substantially fluid-tight seal therebetween. The hollow body portion 44 typically includes at least one aperture 50 formed therein to allow a fluid to flow therethrough. An interior 52 of the hollow body portion 44 is in fluid communication with an outlet 53 formed in the wall of the main body 12 via the aperture 50.

As shown, the plunger 46 includes a hollow tube-shaped body 56 having a passage 57 formed therethrough. An open first end 58 of the plunger 46 is slideably disposed in the hollow body portion 44 of the adjustment element 42. In the illustrated embodiment, the first end 58 includes a radially outwardly extending annular flange portion 59 formed thereon. It is understood that the flange portion 59 can be separately formed or integrally formed with the hollow tube-shaped body 56 if desired. The flange portion 59 selectively abuts a surface of the hollow body portion 44 to militate against an undesired withdrawal of the plunger 46 from the hollow body portion 44. An opposite second end 60 of the plunger 46 extends into and is in fluid communication with the chamber 23 of the piston section 16. The second end 60 shown includes a sealing portion 61 disposed thereon. In the illustrated embodiment, the sealing portion 61 is a cap-like member having a central aperture formed therein to permit the flow of the fluid into the passage 57 of the plunger 46. It is understood that the sealing portion 61 can be separately formed or integrally formed with the hollow tube-shaped body 56 if desired. It is further understood that the sealing portion 61 can be formed from any suitable material to form a fluid tight seal between the sealing portion 61 and a face of the piston 32 such as a rubber material, for example.

As shown, the aperture formed in the sealing portion 61 of the plunger 46, the passage 57 of the plunger 46, the interior 52 of the hollow body portion 44, and the outlet 53 are fluidly connected to form a second fluid flow path. The second fluid flow path is in fluid communication with the chamber 23 and a point upstream of the inlet valve 26 via a bypass conduit 54. The fluid from the chamber 23 flows into the aperture formed in the second end 60 of the plunger 46, through the second fluid flow path, and into the through the bypass conduit 54 to be reintroduced into the pump 10.

Figure 2:
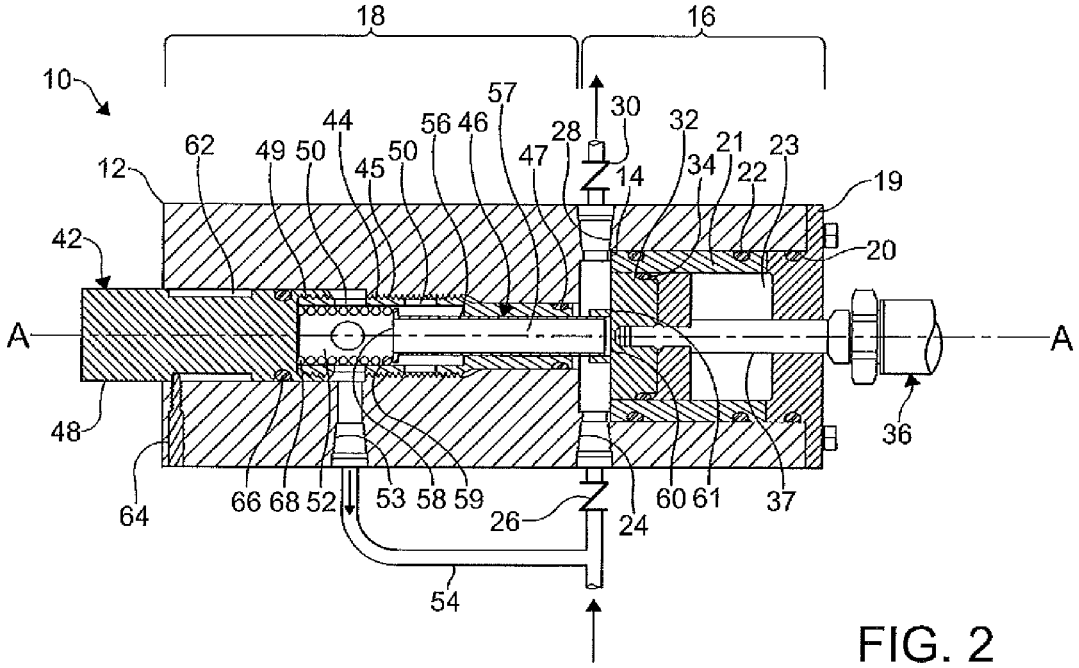
FIG. 2 is a cross-sectional side elevational view of the pump of FIG. 1 showing the piston in a second position and the adjustment element in the maximum flow position.
Figure 3:
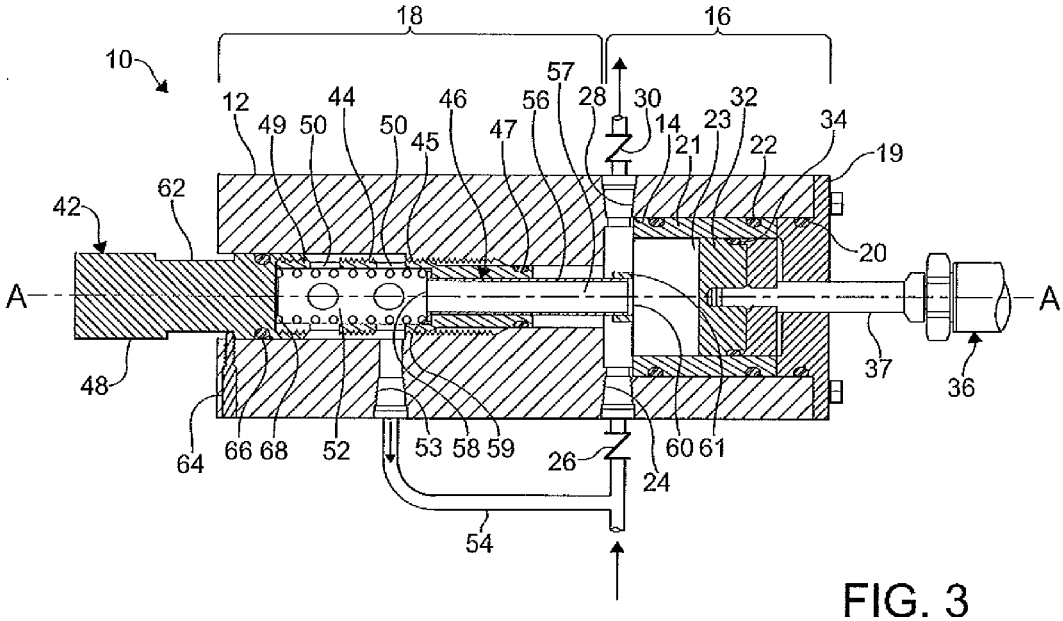
FIG. 3 is a cross-sectional side elevational view of the pump of FIG. 1 showing the piston in the first position and the adjustment element in a minimum flow position.
Figure 4:
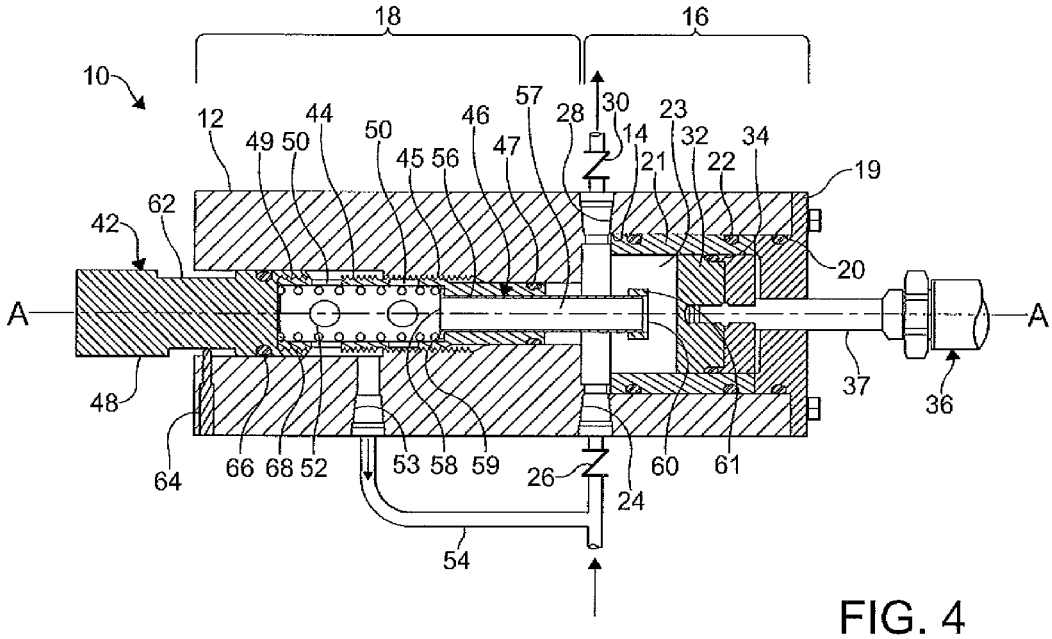
FIG. 4 is a cross-sectional side elevational view of the pump of FIG. 1 showing the piston in the first position and the adjustment element in an intermediate flow position between the maximum flow position and the minimum flow position.

The displacement adjuster 48 is coupled to the hollow body portion 44 opposite the plunger 46. The displacement adjuster 48 is selectively positionable between a maximum flow position, as shown in FIGS. 1-2, and a minimum flow position, as shown in FIG. 3. It is understood that the displacement adjuster 48 can be selectively positioned in an intermediate flow position between the maximum flow position and the minimum flow position, as shown in FIG. 4 if desired. In the embodiment shown, the displacement adjuster 48 has a generally cylindrical body with a recessed portion 62 (i.e. annular channel) circumferentially formed therein. A locking device 64 (e.g. threaded pin, set screw, and the like) is typically disposed through the wall of the main body 12. The locking device 64 abuts a wall forming the recessed portion 62 to limit a range of axial movement of the displacement adjuster 48 by abutting edges of the recessed portion 62 at opposite ends thereof, and thereby the adjustment element 42. It is understood that the recessed portion 62 can have any size and shape.

In the illustrated embodiment, the displacement adjuster 48 is coupled to a portion of the hollow body portion 44 such as by a threaded connection 49, for example. As a non-limiting example, the displacement adjuster 48 includes a sealing member 66 (e.g. O-ring) disposed thereon to sealingly abut the inner surface of the main body 12 defining the control section 18 of the passage 14. It is understood that the displacement adjuster 48 can include a channel or notched portion to receive and secure the sealing member 66 therein.

In certain embodiments, an urging mechanism 68 is disposed in the interior 52 of the hollow body portion 44 of the adjustment element 42. The urging mechanism 68 is interposed between the plunger 46 and the displacement adjuster 48 to urge the plunger 46 toward the piston 32. In the illustrated embodiment, the flange portion 59 of the plunger 46 selectively abuts the urging mechanism 68. As a non-limiting example, the urging mechanism 68 is a spring having a desired spring constant or pre-tension to oppose the movement of the plunger 46 toward the displacement adjuster 48. It is understood, however, that the urging mechanism 68 can have any spring constant or pre-tension as desired.

In operation, the adjustment element 42 can be placed in a maximum flow position (i.e. full fluid displacement of the plunger 46), as shown in FIGS. 1-2. As a non-limiting example, the displacement adjuster 48 can be engaged (e.g. linearly force or rotated) to cause the hollow body portion 44 to change a position relative to the piston 32. However, other means of positioning the adjustment element 42 can be used. When the adjustment element 42 is placed in the maximum flow position, the face of the piston 32 sealingly abuts the second end 60 of the plunger 46, thereby militating against a flow of fluid from the chamber 23 through the second fluid flow path formed by the aperture of the sealing portion 61 of the plunger 46, the passage 57 of the plunger 46, the interior 52 of the hollow body portion 44, and the outlet 53.

The piston 32 is then caused to move by the drive means 36 in a first axial direction in respect of the axis A from the first position, shown in FIG. 1, toward the second position, shown in FIG. 2. Since the second fluid flow path is effectively sealed from the chamber 23, as the piston 32 moves toward the second position, the piston 32 causes the plunger 46 to compress the urging mechanism 68 and a pressure within the chamber 23 to increase. When the pressure within the chamber 23 reaches a first pressure needed to initiate a flow of fluid through the first fluid flow path, the inlet valve 26 is closed whilst the outlet valve 30 is opened, permitting at least a portion of the fluid in the chamber 23 to be discharged from the pump 10 through the outlet 28.

After the fluid is discharged from the chamber 23, the piston 32 is caused to move by the drive means 26 in an opposite second axial direction in respect of the axis A from the second position toward the first position. As the piston 32 moves, the pressure within the chamber 23 is decreased, thereby creating a vacuum in the chamber 23. When the pressure within the chamber 23 reaches a second pressure needed to militate against the flow of fluid through the first fluid flow path, the outlet valve 30 is closed whilst the inlet valve 26 is opened permitting at least a portion of the fluid to flow from the source of fluid, through the inlet 24, and into the chamber 23. It is understood that, as the piston 32 moves in the second axial direction, the urging mechanism 68 substantially simultaneously causes the second end 60 of the plunger 46 to maintain sealing abutment with the face of the piston 32. The axial reciprocating movement of the piston 32 is repeated causing no flow of the fluid through the second fluid flow path and an effective flow of the fluid through the outlet 28 of the first fluid flow path until a desired volume of fluid is dispensed from the pump 10.

When the adjustment element 42 is placed in the minimum flow position (i.e. zero fluid displacement of the plunger 46), as shown in FIG. 3, the face of the piston 32 is spaced from the second end 60 of the plunger 46. Accordingly, the second fluid flow path formed by the passage 57 of the plunger 46, the interior 52 of the hollow body portion 44, and the outlet 53 is permitted to receive the fluid therein. As the piston 32 moves in the first axial direction in respect of the axis A from the first position toward the second position, at least a portion of the fluid within the chamber 23 is received into and caused to flow into the aperture formed in the sealing portion 61 of the second end 60 of the plunger 46, through the second fluid flow path and into the bypass conduit 54. Since the fluid is permitted to flow through the second fluid flow path, the pressure within the chamber 23 does not reach the first pressure. As such, the inlet valve 26 and the outlet valve 30 remain closed causing a flow of the fluid through the second fluid flow path and no effective flow of the fluid through the first fluid flow path.

It is understood that variable rates of effective flow of the fluid can be obtained by a position of the adjustment element 42 relative to the piston 32. For example, as shown in FIG. 4, the adjustment element 42 can be set to the intermediate flow position. When the adjustment element 42 is placed in the intermediate flow position, the face of the piston 32, initially, is spaced from the second end 60 of the plunger 46. Accordingly, the second fluid flow path formed by the aperture of the sealing portion 61 of the plunger 46, the passage 57 of the plunger 46, the interior 52 of the hollow body portion 44, and the outlet 53 is permitted to receive the fluid therein. As such, as the piston 32 moves in the first axial direction in respect of the axis A from the first position toward the second position, a portion of the fluid within the chamber 23 is received into and caused to flow into the aperture of the sealing portion 61 of the plunger 46, through the second fluid flow path and into the bypass conduit 54. It is understood that, as the piston 32 moves in the first axial direction in respect of the axis A, a space between the face of the piston 32 and the second end 60 of the plunger 46 decreases. At a point during the movement of the piston 32 in the first axial direction in respect of the axis A, the face of the piston 32 sealingly abuts the second end 60 of the plunger 46, thereby militating against the flow of fluid from the chamber 23 through the second fluid flow path. Since the second fluid flow path is effectively sealed from the chamber 23, as the piston 32 continues to move toward the second position, the piston 32 causes the plunger 46 to compress the urging mechanism 68 and a pressure within the chamber 23 to increase. When the pressure within the chamber 23 reaches the first pressure needed to initiate the flow of fluid through the first fluid flow path, the inlet valve 26 is closed whilst the outlet valve 30 is opened permitting a portion of the fluid in the chamber 23 to be discharged from the pump 10 through the outlet 28. Accordingly, the axial movement of the piston 32 causes a flow of fluid through the second fluid flow path and no effective flow of the fluid through the first fluid flow path until the piston 32 sealingly abuts the second end 60 of the plunger 46. Once the piston 32 sealingly abuts the second end 60 of the plunger 46, the axial movement of the piston 32 causes no flow of the fluid through the second fluid flow path and an effective flow of the fluid through the first fluid flow path.

After the fluid is discharged from the chamber 23, the piston 32 is caused to move by the drive means 26 in an opposite second axial direction in respect of the axis A from the second position toward the first position. As the piston 32 moves, the pressure within the chamber 23 is decreased, thereby creating a vacuum in the chamber 23. When the pressure within the chamber 23 reaches a second pressure needed to militate against the flow of fluid through the first fluid flow path, the outlet valve 30 is closed whilst the inlet valve 26 is opened permitting at least a portion of the fluid to flow from the source of fluid, through the inlet 24, and into the chamber 23. It is understood that, as the piston 32 moves in the second axial direction, the urging mechanism 68 substantially simultaneously causes the second end 60 of the plunger 46 to maintain sealing abutment with the face of the piston 32. At a point during the movement of the piston 32 in the second axial direction in respect of the axis A, the face of the piston 32 becomes spaced from the second end 60 of the plunger 46. It is also understood that, as the piston 32 continues to move in the second axial direction in respect of the axis A, the space between the face of the piston 32 and the second end 60 of the plunger 46 increases.

The pump 10 of the present invention facilities an adjustable effective flow of the fluid through the first fluid flow path, without altering a stroke of the piston 32. In this way, the pump 10 facilitates adjustment of a volume of the fluid discharged from the pump 10 and a volume of the fluid reintroduced into the pump 10 in a controlled manner. The pump 10 produces a regular flow, regardless of the pressure or the viscosity of the liquid.

From the foregoing description, one ordinarily skilled in the art can easily ascertain the essential characteristics of this invention and, without departing from the spirit and scope thereof, make various changes and modifications to the invention to adapt it to various usages and conditions.

What is claimed is:

1. A piston pump comprising:

a main body including an inlet, a first outlet, and a chamber formed therein, wherein the inlet, the first outlet, and at least a portion of the chamber are fluidly connected to form at least a portion of a first fluid flow path for receiving a flow of fluid therein;

a piston disposed in the chamber and configured to reciprocatingly move therein;

an adjustment element at least partially disposed in the main body, the adjustment element configured to adjust an effective flow of the fluid through the first fluid flow path, wherein the adjustment element includes a plunger displaceable relative to the piston; and a second fluid flow path providing fluid communication between the chamber and a point upstream of the inlet of the main body, wherein the piston selectively abuts an end of the plunger to impede a flow of fluid through the second fluid flow path.

2. The pump of claim 1, wherein the adjustment element is selectively positionable between a maximum flow position and a minimum flow position.

3. The pump of claim 1, wherein the adjustment element further comprises a hollow body portion having at least a portion of the plunger disposed therein and a displacement adjuster coupled to the hollow body portion for controlling a displacement of the plunger.

4. The pump of claim 3, wherein at least a portion of the second fluid flow path is formed by a passage formed in the plunger, an interior of the hollow body portion, and a second outlet formed in the main body.

5. The pump of claim 3, wherein a range of axial movement of the displacement adjuster relative to a central axis of the pump is selectively controlled by a locking device at least partially disposed in the main body.

6. The pump of claim 3, further comprising an urging mechanism interposed between the plunger of the adjustment element and the displacement adjuster of the adjustment element.

7. The pump of claim 6, wherein a force upon the plunger of the adjustment element by the urging mechanism is in opposition to a movement of the plunger toward the displacement adjuster.

8. A piston pump comprising:

a main body including an inlet, a first outlet, and a chamber formed therein, wherein the inlet, the first outlet, and at least a portion of the chamber are fluidly connected to form at least a portion of a first fluid flow path for receiving a flow of fluid therein;

a piston disposed in the chamber and configured to reciprocatingly move therein;

an adjustment element at least partially disposed in the main body, the adjustment element configured to adjust an effective flow of the fluid through the first fluid flow path, wherein the adjustment element includes a hollow body portion, a plunger having a passage formed therein and at least partially disposed in the hollow body portion, and a displacement adjuster coupled to the hollow body portion for controlling a displacement of the plunger; and a second fluid flow path at least partially formed by the passage of the plunger, an interior of the hollow body portion, and a second outlet formed in the main body, wherein the second fluid flow path provides fluid communication between the chamber and a point upstream of the inlet of the main body, wherein the piston selectively abuts an end of the plunger to impede a flow of fluid through the second fluid flow path.

9. The pump of claim 8, wherein the adjustment element is selectively positionable between a maximum flow position and a minimum flow position.

10. The pump of claim 9, wherein the effective flow of the fluid through the first fluid flow path is maximized and the flow of the fluid through the second fluid flow path is minimized when the adjustment element is in the maximum flow position.

11. The pump of claim 9, wherein the effective flow of the fluid through the first fluid flow path is minimized and the flow of the fluid through the second fluid flow path is maximized when the adjustment element is in the minimum flow position.

12. The pump of claim 9, wherein the effective flow of the fluid through the first fluid flow path is between a maximum and a minimum and the flow of the fluid through the second fluid flow path is between a maximum and a minimum when the adjustment element is in an intermediate flow position between the maximum flow position and the minimum flow position.

13. The pump of claim 8, further comprising an urging mechanism interposed between the plunger of the adjustment element and the displacement adjuster of the adjustment element.

14. The pump of claim 13, wherein a force upon the plunger of the adjustment element by the urging mechanism is in opposition to a movement, of the plunger toward the displacement adjuster.

* * * * *